United States Patent [19]

Beninca' et al.

[11] 4,166,368

[45] Sep. 4, 1979

[54] SUCTION DEVICE FOR REMOVING LIQUIDS FROM MACHINE-TREATED TEXTILES

[75] Inventors: Marcello Beninca', Arzignano; Mario Lora, Valdagno, both of Italy

[73] Assignee: Rimar Meccanica S.p.A., Carpendolo, Italy

[21] Appl. No.: 870,182

[22] Filed: Jan. 17, 1978

[30] Foreign Application Priority Data

Jan. 18, 1977 [IT] Italy ..... 5107 A/77

[51] Int. Cl.[2] ..... D06B 1/02; D06B 15/04

[52] U.S. Cl. ..... 68/20; 15/306 A; 34/115; 68/205 R; 118/50

[58] Field of Search ..... 68/20, 205 R; 118/50; 15/306 R, 306 A, 307; 34/92, 115; 134/64 R, 64 P, 122 R, 122 P

[56] References Cited

U.S. PATENT DOCUMENTS

| | | | |
|---|---|---|---|
| 1,759,804 | 5/1930 | Pieron | 15/306 A X |
| 1,771,558 | 7/1930 | De Repentigny | 15/306 A X |
| 2,080,635 | 5/1937 | Schramek et al. | 68/205 R |
| 3,149,004 | 9/1964 | Fleissner | 34/115 X |
| 3,589,147 | 6/1971 | Price et al. | 68/20 X |
| 4,044,716 | 8/1977 | Riddle | 118/50 |

*Primary Examiner*—Philip R. Coe

[57] ABSTRACT

In a suction device for removing liquids from textile fabrics, there is provided a tubular body that is adapted to be connected to a suction unit. The tubular body has at least two longitudinal angularly spaced apart passages through the wall thereof. At least three sectors are attached to the outer surface of the body in order to define, with their respective, opposed edges, at least two longitudinal slots that are in registration with the passages in a tubular body. A roller is positioned intermediate the slots and tangentially to the body for advancing the fabric past the slots. A shower head may be provided for ejecting a fabric treating liquid.

5 Claims, 3 Drawing Figures

SUCTION DEVICE FOR REMOVING LIQUIDS FROM MACHINE-TREATED TEXTILES

FIELD OF THE INVENTION

The present invention relates to a suction device of the type employable particularly, although not exclusively, in installations for washing and/or sizing and/or treating textile fabrics or goods. More particularly, the invention relates to an improved suction device having a plurality of longitudinal suction slots through which is removed the liquid from the fabric being treated.

BRIEF DESCRIPTION OF THE PRIOR ART

In the field of installations for treatment of textile fabrics or goods, there are already known several types of suction devices. However, their use is not efficient or functionally satisfactory, in that such devices comprise, generally, a cylindrical body having one single slot which is oriented so as to be adjacent to or in contact with the fabric and remove therefrom, by suction action, the liquids.

Furthermore, the use of known suction devices having a single slot does not insure the necessary energetic mechanical action during the phases of washing, sizing or the like, so that good results of the treatment are entrusted almost exclusively to the chemical action of the chemical agents used, which (as is well known) gives rise however to a complex and onerous work of the fabric through liquid treating baths and batteries of successive suction devices.

BRIEF SUMMARY OF THE INVENTION

It is an object of the present invention to provide an improved suction device having two or more suction slots acting on the fabric, without thus effecting a proportional increase in friction and tension of the fabric during treatment and without need for cleaning devices because the present suction device is self-cleaning.

It is another object of the present invention to provide a suction device of simple conception and assured operability, which has at least two radial suction slots that permit a continuous alternating action of washing the fabric with a treating fluid and of sucking off said fluid through the fabric itself, while the fabric is displaced tangentially on the suction device. What results is an energetic mechanical action combined with a chemical treating action; in other words, a perfect washing action without requiring extra liquid bath treatments of the fabric.

It is still another object of the invention to provide a suction device having a plurality of radial suction slots which are all controlled by a single suction unit and thus reduce or minimize equipment encumbrances to reduce the number of suction tubes required and, obviously, their operating costs.

Briefly stated, these objects are achieved by the present suction device which comprises a tubular, preferably cylindrical, body defining an axial suction conduit connected to a suction unit, the cylindrical body having at least two radial and longitudinal openings or passages, angularly spaced from one another. The device further has at least three cylindrical sectors attached on the outer surface of said body to define with the respective contiguous borders at least two longitudinal slots in registration with said passages in the cylindrical body. Intermediate said slots there is mounted a roller for advancing the fabric so that the fabric might move tangentially with respect to the slots.

BRIEF DESCRIPTION OF THE DRAWINGS

Greater details of the invention will become apparent from the following description thereof with reference to the accompanying drawings which are illustrative of a preferred embodiment thereof and in which.

DETAILED DESCRIPTION OF THE INVENTION

Figure 1:
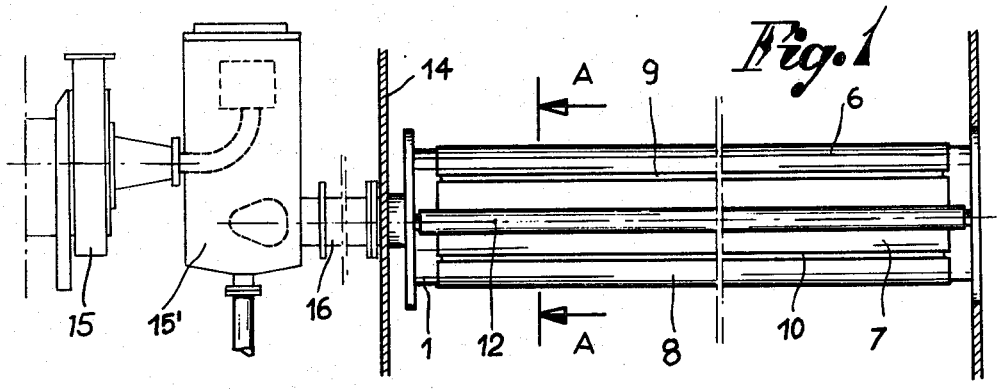
FIG. 1 is a schematic elevational view of the device of the invention associated with a central suction unit.

The device of the present invention comprises, referring to the accompanying drawings, a tubular body 1, preferably but not necessarily cylindrical, which body defines an axial conduit 2 and has at least two radial and longitudinal passages 3, 4. These passages, for constructional reasons, do not cover longitudinally the entire tubular body, but only a portion thereof. These radial passages 3, 4 are angularly spaced from one another and, if necessary, the tubular sector or sectors 1', comprised between the passages (see FIG. 2) are reinforced by means, for example, of members 5 suitably attached so as to prevent undesirable bending of the tubular sectors themselves.

On the outer surface of the tubular body 1 there are mounted at least three cylindrical sectors 6, 7 and 8, positioned so as to define with their respective contiguous borders 6', 7' and 8' at least two slots 9 and 10 in registration with the lateral passages 3, 4 of the body. These cylindrical sectors 6, 7, 8 have a length at least equal to that of the passages 3, 4 and are attached to the body 1 by means of fasteners 11 so as to be reciprocally positionable with respect to the body and so as to vary and regulate the slot opening P.

Figure 2:
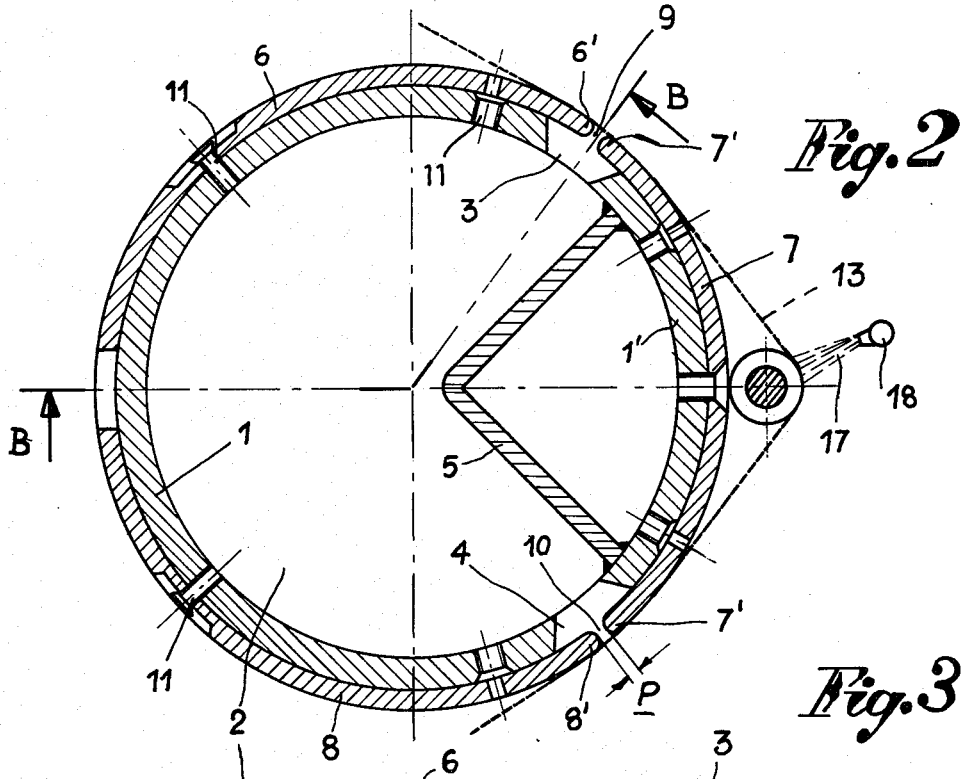
FIG. 2 is sectional view of the device taken along arrows A—A of FIG. 1.

Externally of the hereabove described tube, intermediate the slots 9–10, there is positioned a roller 12 which acts on the tube and serves to advance the fabric 13 during the treating stage, so that the fabric itself will be tangentially approaching the surface of the suction tube only in the vicinity of said slots so as to become subjected to the suction action effected through the slots—see phantom lines in FIG. 2—. In this manner, the friction and the tension on the fabric at the suction zones are fully eliminated and a more regular advance of the fabric is insured.

Figure 3:
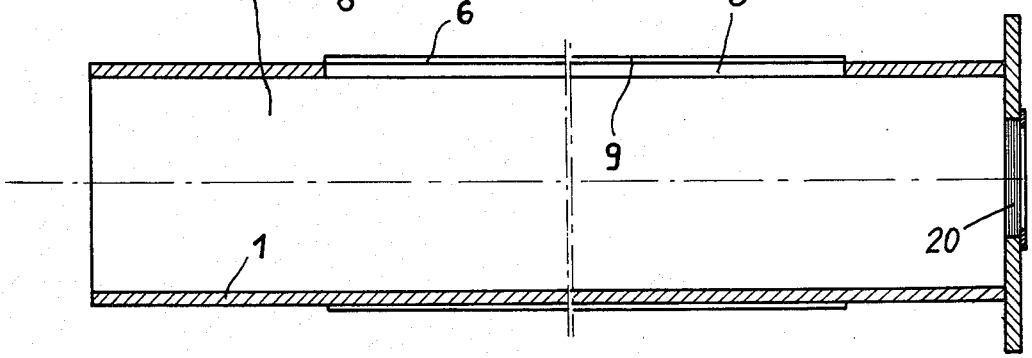
FIG. 3 is a longitudinal sectional view of the device taken along arrows B—B of FIG. 2.

For its employment in an installation for treating fabrics with vacuum-removable liquids, the suction device, after being installed between the walls of a treating chamber 14, is connected (see FIG. 1) to a central suction unit 15 with or without the interposition of a suitable air-solvent separator 15' (conventially known apparatus). This connection is effected by means of a conduit 16 attached at one extremity of the axial conduit 2 of the tubular body 1. Obviously, the opposite end of axial conduit 2 is sealed and has preferably inspection glass ports 20 (FIG. 3). The fabric 13, to be treated, is guided on the suction tube and, as it advances, is invested by treating liquid 17 applied by means of shower heads 18. These shower heads are positioned preceding each slot 9–10. Thus, the fabric 13, before passing each slot 9, 10, is subjected to an impregnation of treating liquid, which liquid is then removed by suction through the fabric and sucked off at the slots. As a result, the fabric 13, during its travel around the suction device is subjected alternately to a washing action and to a suction action with a resulting energetic mechanical action of fabric-washing and a more efficient treatment then obtainable heretofore in prior art equipment.

It is to be observed, finally, that although the above description relates to a suction device with two slots, the invention does not exclude the use of a greater number of slots depending on the diameter of the tube itself, on the type of fabric being treated, on the efficiency of the treatment desired, etc. All of this without departing from the scope of the invention which provides, as stated hereabove, for an alternated washing of the fabric and suction of the treating liquid, while the fabric is displaced around the tube.

What is claimed is:

1. Suction device for removal of liquids from textile fabrics subjected to washing, sizing and the like treatments, said device comprising:

a tubular body defining an axial suction conduit for connection to a central suction unit;

at least two passages in the said body, said passages being radial, longitudinal and angularly spaced from one another;

at least three cylindrical sectors attached on the outer surface of said body to define with their respective contiguous borders at least two longitudinal slots in juxtaposition with said passages;

a roller positioned externally of said body and between said slots for advancing said fabric past said slots.

2. The device according to claim 1, wherein said passages are longitudinally shorter than the length of said body, and wherein said sectors are at least as long as the passages.

3. The device according to claim 1, wherein said sectors are attached to said tubular body so as to be reciprocally positionable for varying the width of said slots.

4. The device according to claim 1, wherein each sector comprised between successively adjacent slots is reinforced with innerly protruding members.

5. The device according to claim 1, wherein said roller is positioned tangentionally with respect to said body, and intermediate said slots there is positioned at least one shower head for ejection of a fabric-treating liquid onto said fabric.

* * * * *